US006666041B1

(12) United States Patent
Agergaard

(10) Patent No.: US 6,666,041 B1
(45) Date of Patent: Dec. 23, 2003

(54) REFRIGERATOR WITH CYCLONE LIQUID GAS SEPARATOR

(75) Inventor: Povl Agergaard, Vojens (DK)

(73) Assignee: Gram Equipment A/S, Vojens (DK)

( * ) Notice: Subject to any disclaimer, the term of this patent is extended or adjusted under 35 U.S.C. 154(b) by 0 days.

(21) Appl. No.: 10/070,542

(22) PCT Filed: Sep. 7, 2000

(86) PCT No.: PCT/DK00/00493

§ 371 (c)(1),
(2), (4) Date: Mar. 7, 2002

(87) PCT Pub. No.: WO01/22013

PCT Pub. Date: Mar. 29, 2001

(30) Foreign Application Priority Data

Sep. 8, 1999 (DK) ..... 1999 01260

(51) Int. Cl.[7] ..... F25B 41/00; F25B 39/04
(52) U.S. Cl. ..... 62/174; 62/509
(58) Field of Search ..... 62/194, 221, 503, 62/512, 488, 509, 174

(56) References Cited

U.S. PATENT DOCUMENTS

| | | | | |
|---|---|---|---|---|
| 2,570,962 A | | 10/1951 | McBroom | |
| 3,600,904 A | | 8/1971 | Tilney | |
| 3,796,064 A | | 3/1974 | Ladusaw | |
| 4,371,424 A | * | 2/1983 | Anthony | 202/159 |
| 4,509,341 A | | 4/1985 | Zimmern | |
| 4,886,534 A | | 12/1989 | Castan | |
| 5,435,149 A | * | 7/1995 | Strong et al. | 62/218 |
| 5,493,875 A | | 2/1996 | Kozinski | |
| 5,591,310 A | * | 1/1997 | Olrik | 202/160 |

FOREIGN PATENT DOCUMENTS

| | | | |
|---|---|---|---|
| DE | 861100 | | 12/1952 |
| DE | 3316646 | | 12/1983 |
| DK | 74847 | | 10/1952 |
| DK | 147133 | | 4/1984 |
| EP | 0217605 | | 4/1987 |
| EP | 1127845 A2 | * | 8/2001 |

* cited by examiner

*Primary Examiner*—Melvin Jones
(74) *Attorney, Agent, or Firm*—James Creighton Wray; Meera P. Narasimhan

(57) ABSTRACT

A refrigerator comprising evaporator (1), cyclone separator (21), and supply pipe (8) between condensator and evaporator (1). The evaporator (1) is connected to an upper part of the cyclone separator (21) via delivery pipe (3). The cyclone separator (21) is disposed at a distance above the evaporator (1). The lower part of the cyclone separator (21), which is a liquid collecting compartment, is connected to the evaporator (1) via a down pipe (10).

6 Claims, 5 Drawing Sheets

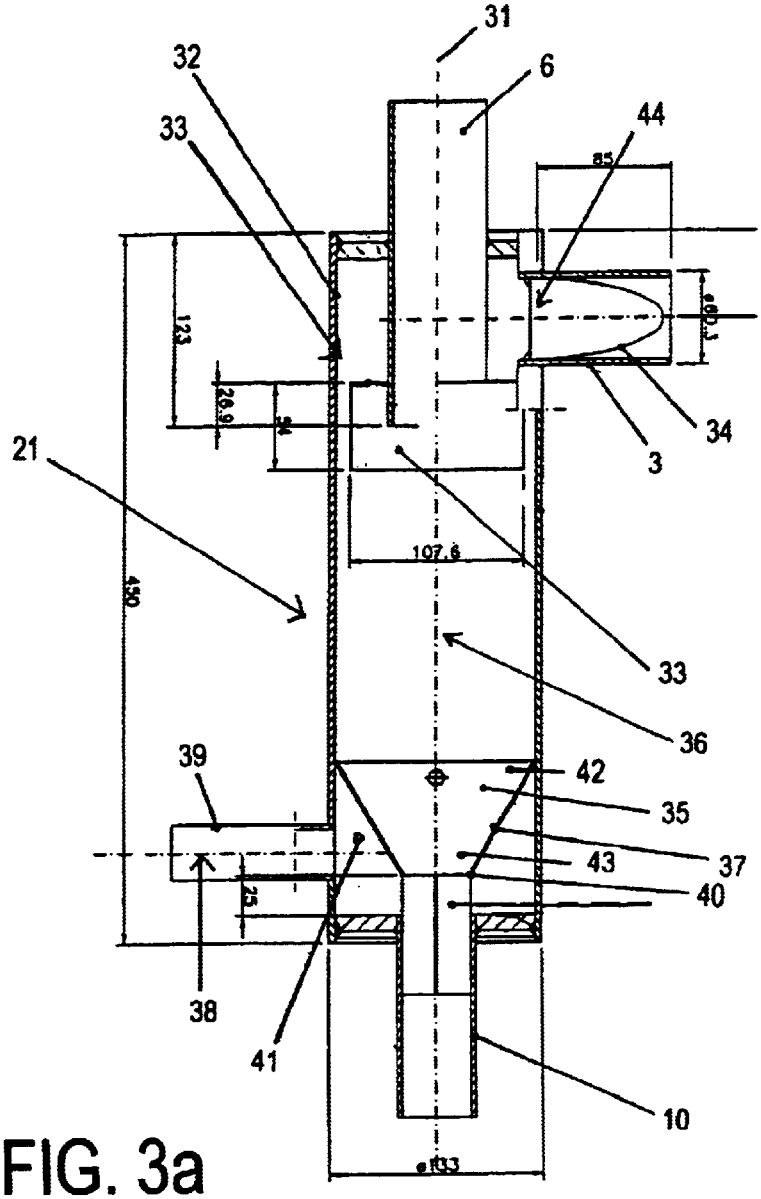
FIG. 3a
FIG. 3b
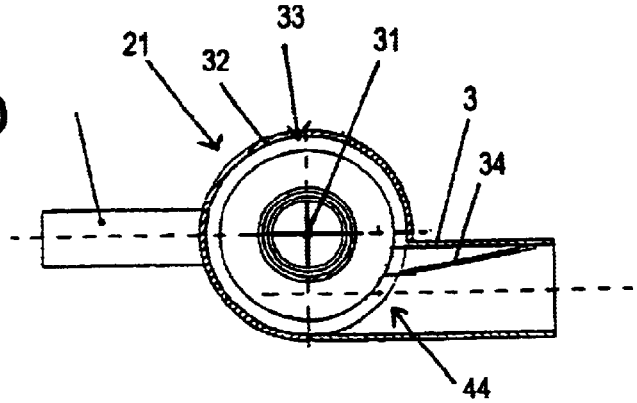

REFRIGERATOR WITH CYCLONE LIQUID GAS SEPARATOR

BACKGROUND OF THE INVENTION

This application claims the benefit of PCT/DK00/00493 filed Sep. 7, 2000 and Danish Application No. PA 1999 01260 filed Sep. 8, 1999.

The present invention concerns a refrigerator as described in the preamble of claim 1.

In the known, high-efficiency refrigerating units, according to prior art there is used drop separators between the evaporator and the suction pipe of the compressor. The drop separator is used for preventing liquid drops of refrigerant from reaching the compressor which would be destructive to the mechanical parts of the compressor, especially the valves. Besides, it is suitable for attaining maximum efficiency that the gas, when leaving the drop separator and is conducted to the compressor via the suction pipe, is dry, i.e. it does not contain refrigerant in the liquid state.

The drop separator works in such a way that the gas and possible liquid drops from the evaporator are sucked into the drop separator where the drops, due to gravitation, fall down to the bottom of the drop separator, after which the dry gas may be sucked to the compressor from the upper part of the drop separator. In order that the separation of gas from the liquid drops is efficient, it is required that the drop separator is relatively large, something which is a disadvantage in general. Furthermore, the use of a large drop separator implies the use of a corresponding large amount of refrigerant which is a further disadvantage as the refrigerant is often poisonous and/or harmful to the environment.

Reduction of the size of a refrigerating unit with corresponding reduction of the amount of the refrigerant as consequence may be achieved by using a centrifugal separator instead of a drop separator. A centrifugal separator functions by the mixture of gas and liquid drops being supplied to a cylindric container in approximately tangential direction. The supply results in a rotating whirl in the cylinder whereby liquid is flung to the rim of the cylinder where it runs down to the bottom of the cylinder, whereafter the dry gas may be sucked out of the central area of the cylinder in the uppermost part of the cylinder.

In Danish laid-open publication DK 147133 B is described a refrigerator using a cyclone separator between the evaporator and an enclosed compressor. The intention is to prevent liquid drops and dirt from getting into the compressor. After separation of the liquid, it is returned to the interior of the enclosure. The refrigerant is here mixed with compressor oil and returned to the system after evaporating the refrigerant from the oil sump in the compressor enclosure.

Furthermore, the refrigerator according the above prior art has the drawback that the cooling efficiency fluctuates during operation which is a great disadvantage in connection with ice cream machines. In ice cream machines it is decisive for the quality of the ice cream that cooling occurs with constant efficiency during the process.

In Danish patent publication DK 74847 is described another design which reduces the necessary amount of refrigerant. The reduction does not, however, depend on a reduction of the size of the liquid separator but is provided by abnormal flow conditions in the evaporator as the liquid is taken in at the top of the evaporator and the sucking occurs lowermost. Thereby accumulation of liquid in the evaporator is avoided whereby the amount of refrigerant is reduced. The design may only, however, function with evaporators shaped as tube batteries and may therefore not be used with flooded evaporators as for example those used in ice cream refrigerators.

European patent application EP 217 605 describes a control method for maintaining a constant liquid level in a refrigerant tank in a refrigerating unit. Here, the controlling occurs on the basis of signals from two level sensors where a step motor influences and sets a valve with varying nozzle area This system has the drawback that the liquid injection is not controlled by the liquid level in the evaporator but by the level in a remote accumulator without any liquid connection between accumulator and evaporator. Thereby a constant liquid level in the evaporator is not ensured. For example, in ice cream refrigerators a constant liquid level in the evaporator is, however, an indispensable necessity in order to achieve a stable operation.

SUMMARY OF THE INVENTION

The purpose of the present invention is to indicate a refrigerator having the known advantages achieved by using a cyclone separator, and which does not have the above mentioned disadvantages.

This purpose is achieved by the present invention by a refrigerator of the type indicated in the introduction, and which is designed with the features described in the characterising part of claim 1.

By using a cyclone separator in the refrigerator according to the invention there is achieved a relatively small refrigerator as the large volume required by a conventional drop separator in the refrigerator may be avoided. This is an advantage during production of refrigerators and also in use.

Due to the reduction of the refrigerator volume by using a cyclone separator, the necessary amount of refrigerant is also much lesser. For example, the typical refrigerant volume ratio between units with drop separator and units with cyclone separator is 12:1. Considering that certain refrigerants, for example ammonia, freon, or propane, are poisonous and/or environmentally harmful by leakage compared with the fact that refrigerators are often located in buildings in which people are working, the reduced amount of refrigerant is a great advantage.

For ensuring a constant efficiency in the refrigerator, four mutually interdependent circumstances and each contributing to equalising fluctuations in the cooling efficiency will be described in the following.

The liquid separated in the cyclone separator is returned to the evaporator via the down pipe in the cyclone separator. The liquid level in the cyclone separator is equal to the liquid level in the delivery pipe above the evaporator. This liquid level is controlled by a level sensor, for example a vibration level switch, in the cyclone separator registering whether the fluid around its sensors is gas or liquid. In the case that the sensor registers liquid in the cyclone separator it is recognised that the evaporator is filled with refrigerant as the sensor is disposed at a distance above the evaporator.

In case the sensor in the cyclone separator does not register any liquid which means that the liquid level in the delivery pipe and possibly the evaporator falls, further refrigerant is supplied to the evaporator via a valve. This refrigerant is substantially returned liquid from the condensator in the refrigeration circuit. In this way it is ensured that the evaporator is always filled with liquid which is one of the circumstances of the invention improving the refrigerator with respect to a more uniform efficiency.

The said valve for supplying refrigerant from the condensator to the evaporator is preferably electronically controlled and has a modulating opening so that the liquid supply to the evaporator occurs in a more even way instead of by discrete portions of a certain size.

If liquid is supplied in portions, there is danger that the liquid circulation in the system starts oscillating which may result in fluctuating efficiency of the refrigeration circuit. The very even supply of refrigerant from the condensator to the evaporator is another circumstance improving the refrigerator with respect to more even efficiency.

Alternatively, the liquid supply is governed by a mechanical device, for example a float connected to a valve, where this valve is characterised by having an opening area varying evenly with the position of the float so that the float may adjust itself according to the actual liquid need while the valve gives an approximately even flow.

The supply of refrigerant from the condensator to the evaporator occurs via an ejector provided in the down pipe. In this way increased circulation is created in the system, improving the efficiency. Besides, the increased circulation counteracts building up of oscillations in the system, contributing to equalisation of the efficiency.

By a further development of the invention, the liquid supply is controlled directly to the cyclone separator via a pipe discharging tangentially in the cyclone. The liquid supply pipe is mounted so that the direction of rotation of the injected liquid is the same as for the gas in the cyclone separator. Hereby further advantages are achieved. First, the rotation of the gas is supported, resulting in a more efficient liquid separation. Second, a faster separation of the so-called flash-gas, that may be formed in the liquid by injection, is achieved. Third, the injected liquid is very quickly collected in the cyclone separator 21 whereby delays between injection and level measuring in the are avoided. Thereby, this device works as a further factor in preventing the arise of oscillations.

The invention is described more closely in the following with reference to the drawing, where:

BRIEF DESCRIPTION OF THE DRAWINGS

FIG. 3 is a schematic drawing of a cyclone separator used in a refrigerator according to the invention.

DETAILED DESCRIPTION OF THE PREFERRED EMBODIMENTS

In the following Figures different embodiments of a machine according to the invention are disclosed. The invention is, however, not limited to the specific designs shown in the Figures.

Figure 1:
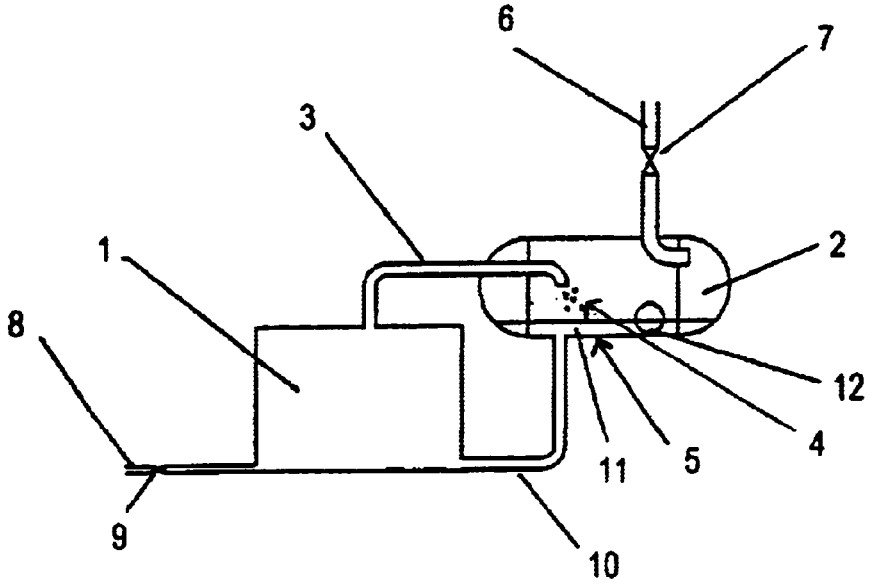
FIG. 1 PRIOR ART
FIG. 1 is a schematic view of an evaporator with drop separator used in a refrigerator according to prior art.

FIG. 1 is a schematic view of an evaporator 1 with drop separator 2 used in a refrigerator according to prior art. From the evaporator 1 refrigerant is evaporating which in a mixture of gas and liquid drops is conducted via delivery pipe 3 to the drop separator 2. In the drop separator 2 the liquid drops 4 falls toward the bottom 5 of the drop separator 2 while the presently dry gas is sucked through a suction pipe 6 with regulating valve 7 to the compressor (not shown). The gas is compressed in the compressor and condensed in the condensator (not shown) whereafter the liquid is supplied to the evaporator 1 via supply pipe 8 with associated valve 9. The drop separator 2 and the evaporator 1 are directly mutually connected via a down pipe 10. A level sensor 12 in the drop separator 2 is controlling that the liquid content of the evaporator does not vary too much. When the level of the liquid 11 in the drop separator 2 falls, the level sensor 12 registers this drop, whereafter the valve 9 is opened so that new liquid is supplied through the supply pipe 8 to the evaporator 1. Traditionally, valves being either open or closed are used, resulting in oscillation of the liquid level in the evaporator with the consequence that the refrigerating efficiency oscillates.

Figure 2:
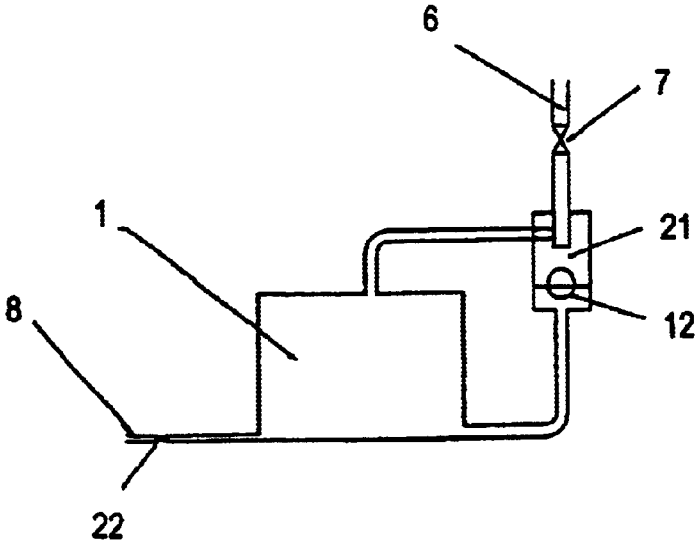
FIG. 2 is a schematic view of an evaporator with cyclone separator used in a refrigerator according to the invention.

FIG. 2 is a schematic view of an evaporator 1 with cyclone separator 21 used in a refrigerator according to the invention. In this embodiment of the invention, the drop separator is provided in the form of a cyclone separator 21 known per se. The cyclone separator 21 is much smaller than the drop separator 2 so that the necessary amount of refrigerant in the refrigerator is considerably reduced. Furthermore, the system for measuring the liquid level in the evaporator 1 is more sensitive due to the lesser amount of liquid whereby adjustments of the liquid level may be regulated more quickly, counteracting oscillations in the liquid circulation Like the drop separator, the cyclone separator 21 has a level sensor 12 for controlling the liquid level above the evaporator. The valve 22 for supplying liquid to the evaporator is, however, of the modulating kind so that the liquid supply via the supply pipe from the condensator to the evaporator is more even than in the machine shown in FIG. 1.

FIG. 3*a* is a schematic drawing of a cyclone separator 21 with vertical, central axis 31 which is used in a refrigerator according to the invention. The cyclone separator 21 consists of a cylindric pipe 32 connected to the delivery pipe 3 in the uppermost part 33. The delivery pipe 3 is disposed off-centre and has an inclining internal wall 34 so that the opening 44 of the delivery pipe 3 to the cyclone separator 21 is narrowed whereby the gas with the liquid drops is supplied to the cylindric pipe 32 in an approximately tangential way. This is made more clear in FIG. 3*b* which is a top view of the cyclone separator 21. The mixture of liquid drops and gas consequently circulates in the cyclone separator 21 with great speed about the vertical axis 31 whereby the drops are flung outward to the cylinder wall 33 and, because of gravitation, flow down into the lower part 35 of the cyclone separator 21. In the central part 36 in the cyclone separator 21 the remaining gas will be dry, i.e. without liquid drops. This dry gas is transported via the suction pipe 6 to the compressor.

In the lower part 35 of the cyclone separator 21, the liquid is collected in a funnel-shaped contraction 37 wherefrom it runs into the down pipe 10 for return to the evaporator. At usual liquid level 38 in the system, the liquid will furthermore fill about half of the pipe 39 to the level sensor. The lower end 40 of the funnel-shaped contraction 37 is localised below the normal liquid level 38 for the turbulence in the liquid in the liquid collecting compartment 41 and around the level sensor to be small. In the shown device, the turbulence in the liquid decreases from the upper part 42 of the funnel-shaped contraction 37 to the lower part 43.

Figure 4:
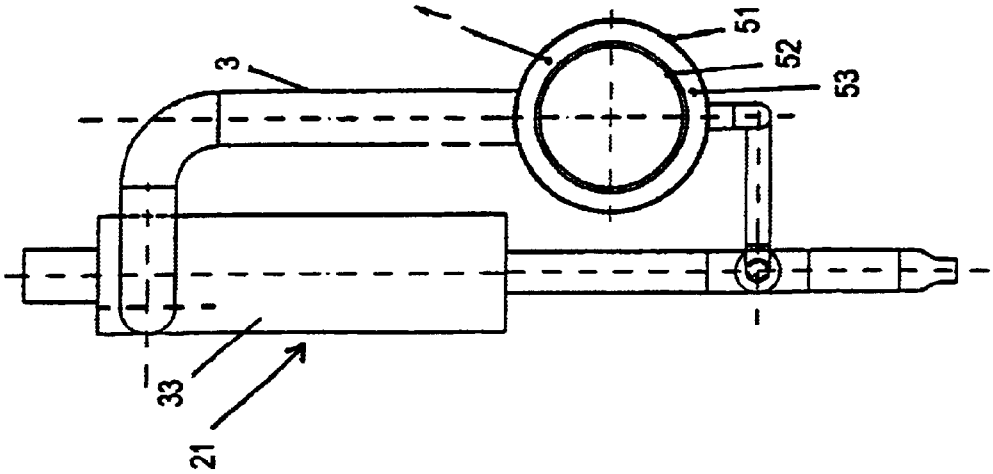
FIG. 4 is a schematic drawing of an evaporator connected with a cyclone separator used in a refrigerator according to the invention.
Figure 4:
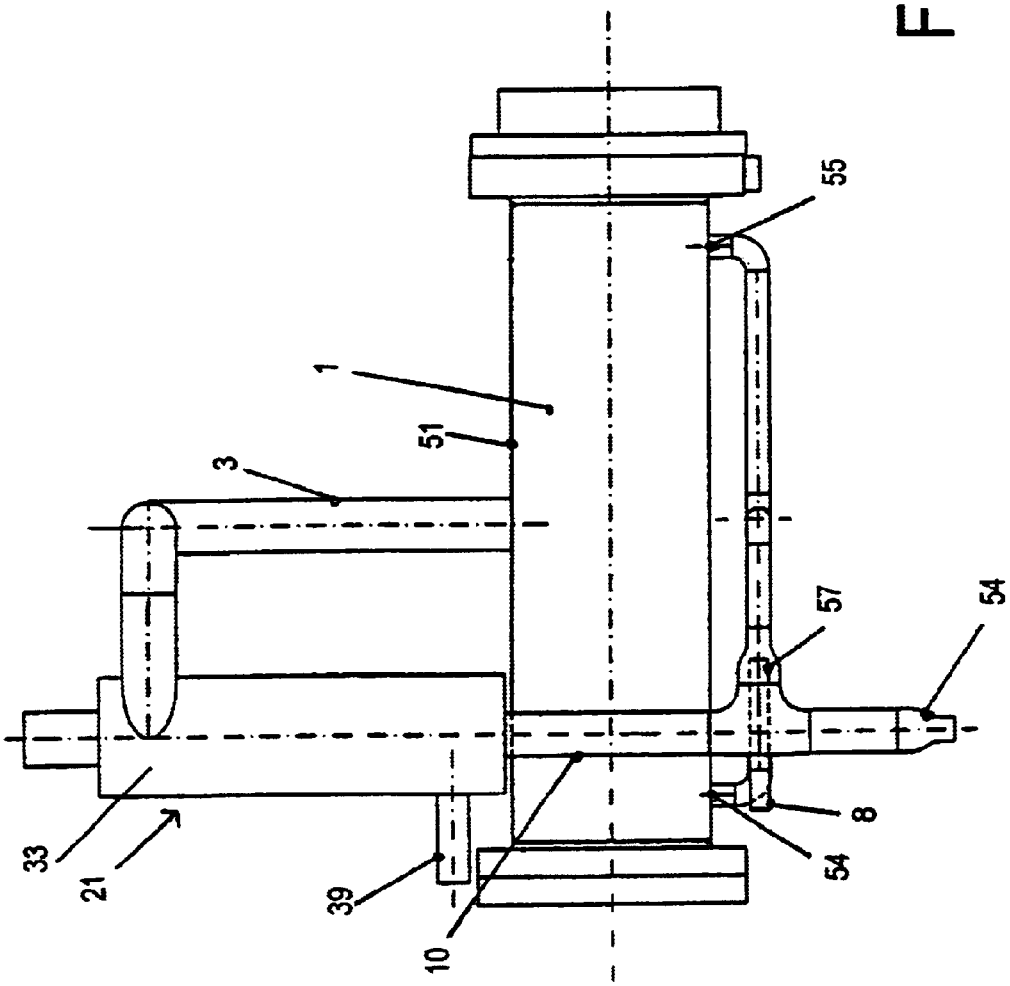

FIG. 4 is a schematic drawing of an evaporator 1 connected with a cyclone separator 21 used for a refrigerator according to the invention. The device shown is drafted in two perspectives. The evaporator 1, in this case an ice cream machine, is cylindric with an outer jacket 51 and an inner freezing cylinder 52. In the inner freezing cylinder the ice cream is produced. The evaporator itself is therefore constituted by the volume 53 delimited by the inner cylinder 52 and the outer jacket 51. The delivery pipe 3 connects the evaporator 1 with the upper part 33 of the cyclone separator 21. In this example, the level sensor is disposed on a pipe 39 above the jacket 51 of the evaporator, for example 66 mm above the evaporator. The down pipe 10 is connected with a drain valve (not shown) at it lower part 54. The down pipe 10 furthermore has two outlets 55 and 56 for return of liquid from the condensator to the evaporator. Besides, the supply pipe 8 from the condensator discharges into an ejector 57 in the down pipe. By supplying refrigerant from the condensator, the flow through this ejector 57 produces entrainment of the liquid in the down pipe 10, enhancing the circulation in the system.

Figure 5:
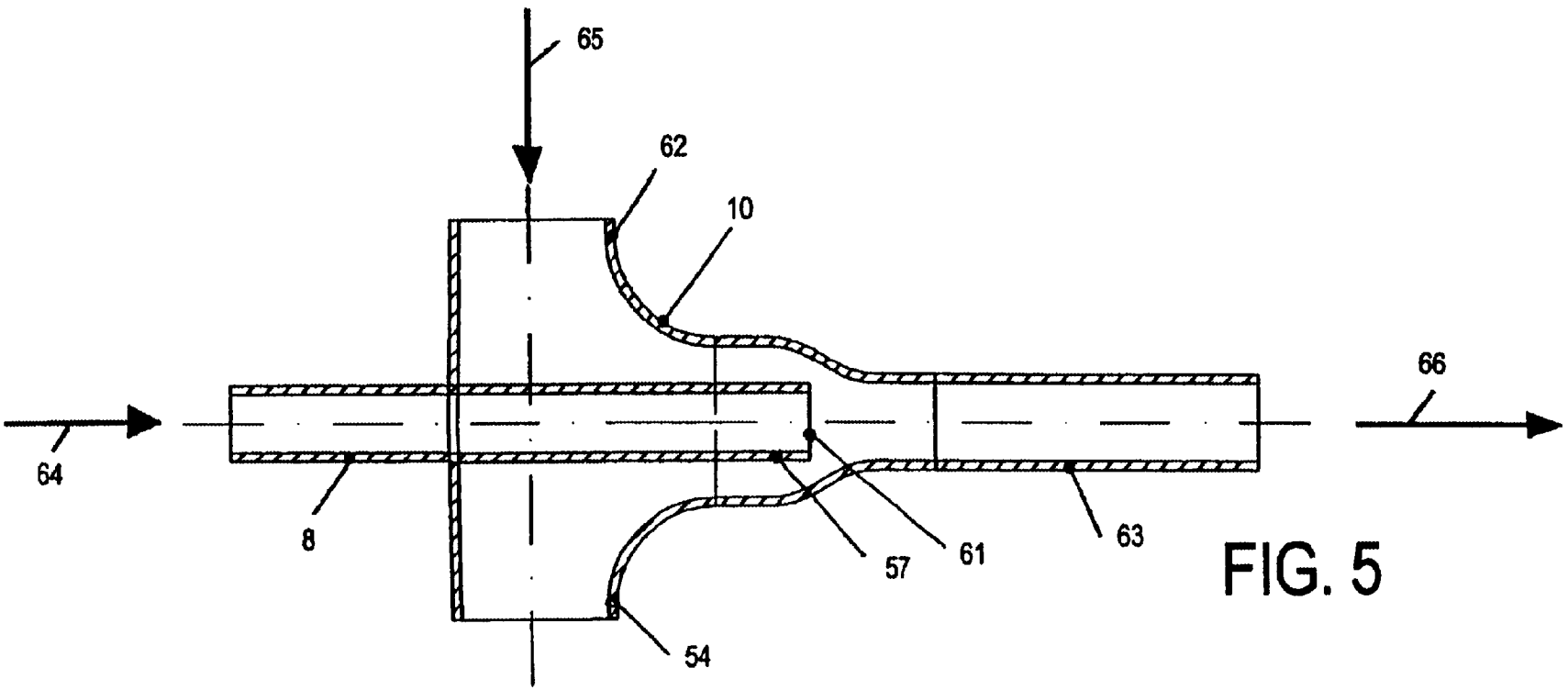
FIG. 5 is schematic drawing of the ejector used in a refrigerator according to the invention.

FIG. 5 is an enlarged schematic drawing of the ejector 57 in the down pipe 10. At the end 61 of the supply pipe 8, the refrigerant supplied from the condensator expands and thereby sucks the liquid in the down pipe 10 with. The refrigerant 64 from the condensator is mixed with refrigerant 65 from the cyclone separator which flows through the upper part 62 of the down pipe 10 whereafter the mixed refrigerant 66 is conducted into the evaporator 1 via the horizontal part 63 of the down pipe 10. The lowermost part 54 of the down pipe is connected with a drain valve.

Figure 6:
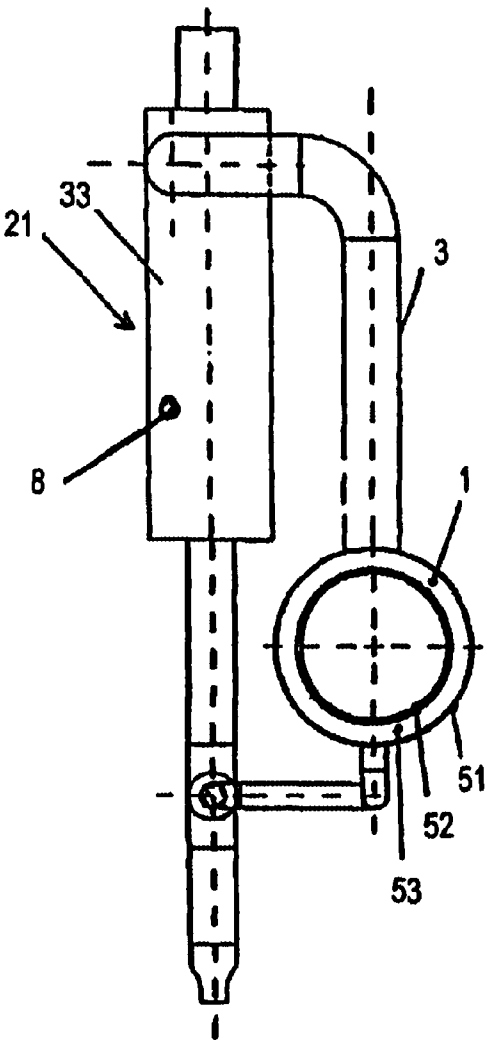
FIG. 6 is a schematic drawing of an alternative embodiment of an evaporator connected with a cyclone separator used in a refrigerator according to the invention.
Figure 6:
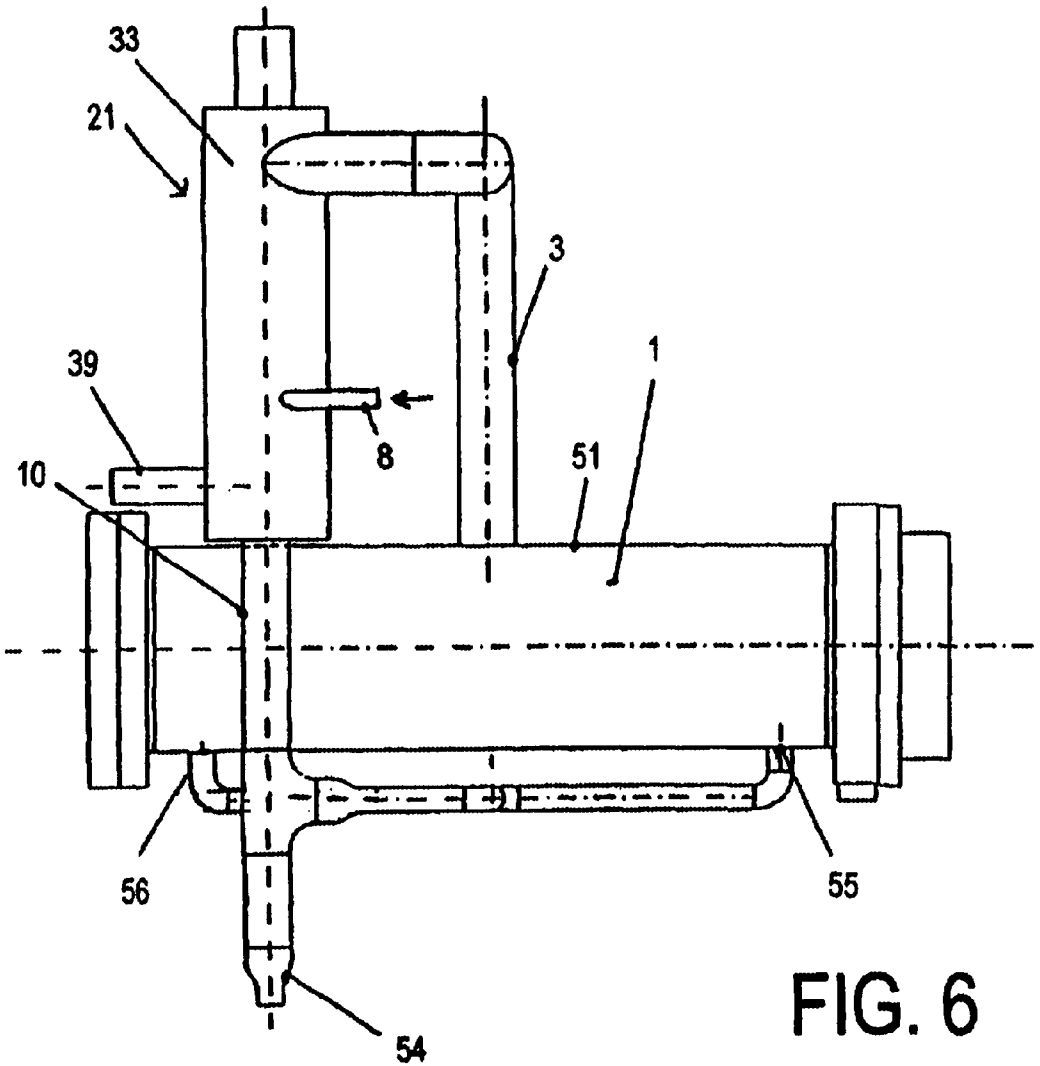

FIG. 6 is a schematic drawing of an alternative embodiment of an evaporator 1 connected with a cyclone separator 21 which is used for a refrigerator according to the invention. This embodiment differs from the one of FIG. 4 in that the supply pipe 8 from the condensator is not discharging into an ejector 57 in the down pipe as shown on FIG. 4 but in that the supply pipe 8' discharges tangentially into the cyclone separator 21. In this case a valve 22 for liquid supply will not be disposed at the location shown on FIG. 2 but be disposed in connection with supply pipe 8'. The supply pipe 8' is mounted in such a way that the direction of rotation of the injected liquid is the same as for the gas in the cyclone separator 21. Thereby further advantages are achieved. First, the rotation of the gas is supported more liquid separation as a consequence. Second, a faster separation of the so-called flash-gas formed in the liquid by injection is achieved. Third, the injected liquid will be collected in the cyclone separator 21 very quickly whereby delays in the system between injection and level measurement are avoided. In this way, this device works as a further factor in preventing the arise of oscillations.

List of numbered designations

1. evaporator
2. drop separator
3. delivery pipe
4. liquid drops
5. bottom of drop separator
6. suction pipe
7. regulating valve
8. supply pipe
9. valve for supply of liquid to the evaporator
10. down pipe
11. liquid in drop separator
12. level sensor
21. cyclone separator
22. modulating valve for supply of liquid to evaporator
31. vertical centre axis
32. cylindric pipe
33. upper part of cyclone separator
34. inclining internal wall of delivery pipe
35. lower part of cyclone separator
36. central part of cyclone separator
37. funnel-shaped contraction
38. liquid level
39. tube for level sensor
40. lower end of funnel-shaped contraction
41. liquid collecting compartment
42. upper part of funnel-shaped contraction
43. lower part of funnel-shaped contraction
44. aperture from delivery pipe to cyclone separator
51. outer jacket of evaporator
52. inner freezing cylinder in evaporator
53. volume between outer jacket and inner freezing cylinder
54. lower part of down pipe
55. inlet to evaporator
56. inlet to evaporator
57. ejector
61. end of supply pipe
62. upper part of down pipe
63. horizontal part of down pipe
64. refrigerant from condensator
65. refrigerant from cyclone separator
66. mixed refrigerant

What is claimed is:

1. A refrigerator comprising evaporator, cyclone separator, and supply pipe for supplying liquid from condensator to evaporator, the evaporator being connected to the upper part of the cyclone separator via a delivery pipe, wherein the cyclone separator is disposed at a distance above the evaporator, the lower part of the cyclone separator, which is a liquid collecting compartment, is connected to the evaporator via a down pipe, the cyclone separator comprises a level sensor for registering liquid level in the collecting compartment of the cyclone separator, the supply duct is connected with a valve, and the level sensor form a part of controlling the valve for maintaining an approximately constant liquid level in the cyclone separator.

2. A refrigerator according to claim 1, wherein the supply pipe from the condensator discharges tangentially into the cyclone separator.

3. A refrigerator according to claim 1, wherein the supply pipe from the condensator to the evaporator discharges into the down pipe, and that the transition between this supply pipe and the down pipe is formed as an ejector for increased circulation of the liquid in the refrigerator.

4. A refrigerator according to claim 1, wherein the level sensor is disposed 50–100 mm, preferably 66 mm, above the evaporator.

5. A refrigerator according to claim 1, wherein the level sensor is a vibration level switch for liquids.

6. A refrigerator according to claim 1, wherein the refrigerator is an ice cream machine.

* * * * *